US012173638B2

(12) United States Patent
Onoue et al.

(10) Patent No.: US 12,173,638 B2
(45) Date of Patent: Dec. 24, 2024

(54) OUTBOARD MOTOR

(71) Applicant: YAMAHA HATSUDOKI KABUSHIKI KAISHA, Iwata (JP)

(72) Inventors: Junya Onoue, Shizuoka (JP); Hiroki Koga, Shizuoka (JP); Yoshiyuki Kadobayashi, Shizuoka (JP); Kimitaka Saruwatari, Shizuoka (JP); Akihiro Noma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 22 days.

(21) Appl. No.: 17/979,040

(22) Filed: Nov. 2, 2022

(65) Prior Publication Data

US 2023/0349314 A1 Nov. 2, 2023

(30) Foreign Application Priority Data

Apr. 28, 2022 (JP) ..... 2022-074703

(51) Int. Cl.
*F01P 5/12* (2006.01)
*F01P 3/20* (2006.01)

(52) U.S. Cl.
CPC ..... *F01P 3/202* (2013.01); *F01P 5/12* (2013.01); *F01P 2005/125* (2013.01); *F01P 2050/12* (2013.01)

(58) Field of Classification Search
CPC ..... F01P 3/202; F01P 2050/12
See application file for complete search history.

(56) References Cited

U.S. PATENT DOCUMENTS

| | | | | |
|---|---|---|---|---|
| 6,415,773 | B1 * | 7/2002 | Katayama | F02M 37/0052 123/514 |
| 2004/0137806 | A1 * | 7/2004 | Ohtsuki | B63H 20/12 440/1 |
| 2015/0367925 | A1 | 12/2015 | Oguma et al. | |
| 2016/0023741 | A1 * | 1/2016 | Davis | B63H 20/02 440/75 |
| 2017/0030239 | A1 * | 2/2017 | Shomura | B63H 20/24 |
| 2020/0370462 | A1 * | 11/2020 | Saruwatari | F01P 3/202 |
| 2020/0370463 | A1 * | 11/2020 | Saruwatari | F01P 3/202 |
| 2021/0061432 | A1 * | 3/2021 | Nanjo | B63H 20/007 |
| 2021/0276685 | A1 * | 9/2021 | Miyagi | B63H 20/00 |
| 2022/0034246 | A1 * | 2/2022 | Harada | F02B 61/045 |
| 2022/0234712 | A1 * | 7/2022 | Arvidsson | B63H 5/1252 |

FOREIGN PATENT DOCUMENTS

JP 2016-005927 A 1/2016

* cited by examiner

*Primary Examiner* — Long T Tran
(74) *Attorney, Agent, or Firm* — Keating & Bennett, LLP

(57) ABSTRACT

An outboard motor includes a bracket, an upper case, a lower case, a drive shaft, a propeller shaft, a cooling water passage, a water pump, and an electric motor. The outboard motor is attached to a watercraft via the bracket. The upper case is below the engine. The lower case is below the upper case. The drive shaft is in the upper case and the lower case. The propeller shaft is connected to the drive shaft. The propeller shaft is in the lower case. The cooling water passage is connected to the engine. The cooling water passage is in the upper case and the lower case. The water pump is below a lower end of the bracket to deliver cooling water to the engine through the cooling water passage. The electric motor is operable to drive the water pump.

12 Claims, 10 Drawing Sheets

OUTBOARD MOTOR

CROSS-REFERENCE TO RELATED APPLICATION

This application claims priority to Japanese Patent Application No. 2022-74703, filed Apr. 28, 2022. The contents of that application are incorporated by reference herein in their entirety.

BACKGROUND OF THE INVENTION

1. Field of the Invention

The present invention relates to an outboard motor.

2. Description of the Related Art

An outboard motor includes a cooling water passage and a pump for supplying cooling water to the engine. A water intake is provided at the bottom of the outboard motor, and the cooling water passage is connected to the engine and the water intake. The pump delivers the cooling water to the engine through the cooling water passage.

For example, the outboard motor disclosed in JP-A-2016-5927 includes a first pump and a second pump. The first pump and the second pump are connected to the drive shaft. The drive shaft is connected to the crankshaft of the engine. The drive shaft rotates by the driving force from the engine to drive the first pump and the second pump. Thereby, the first pump and the second pump send the cooling water to the engine through the cooling water passage.

As mentioned above, if the water pump is driven by the driving force from the engine, the water pump will be driven whenever the engine is rotating, so even if cooling is not required, the cooling water will be supplied to the engine. In addition, since the amount of the cooling water supplied to the engine changes according to the rotation speed of the engine, it is not easy to supply the engine with an amount of the cooling water suitable for cooling the engine.

SUMMARY OF THE INVENTION

Preferred embodiments of the present invention supply an appropriate amount of cooling water to outboard motors to cool the engines therein.

An outboard motor according to a preferred embodiment of the present invention includes a bracket, an upper case, a lower case, a drive shaft, a propeller shaft, a cooling water passage, a water pump, and an electric motor. The outboard motor is attached to a watercraft via the bracket. The upper case is below the engine. The lower case is below the upper case. The drive shaft extends downwardly from the engine. The drive shaft is in the upper case and the lower case. The propeller shaft is connected to the drive shaft. The propeller shaft extends in the front-rear direction of the outboard motor. The propeller shaft is in the lower case. The cooling water passage is connected to the engine. The cooling water passage is in the upper case and the lower case. The water pump is below a lower end of the bracket to deliver cooling water to the engine through the cooling water passage. The electric motor is operable to drive the water pump.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
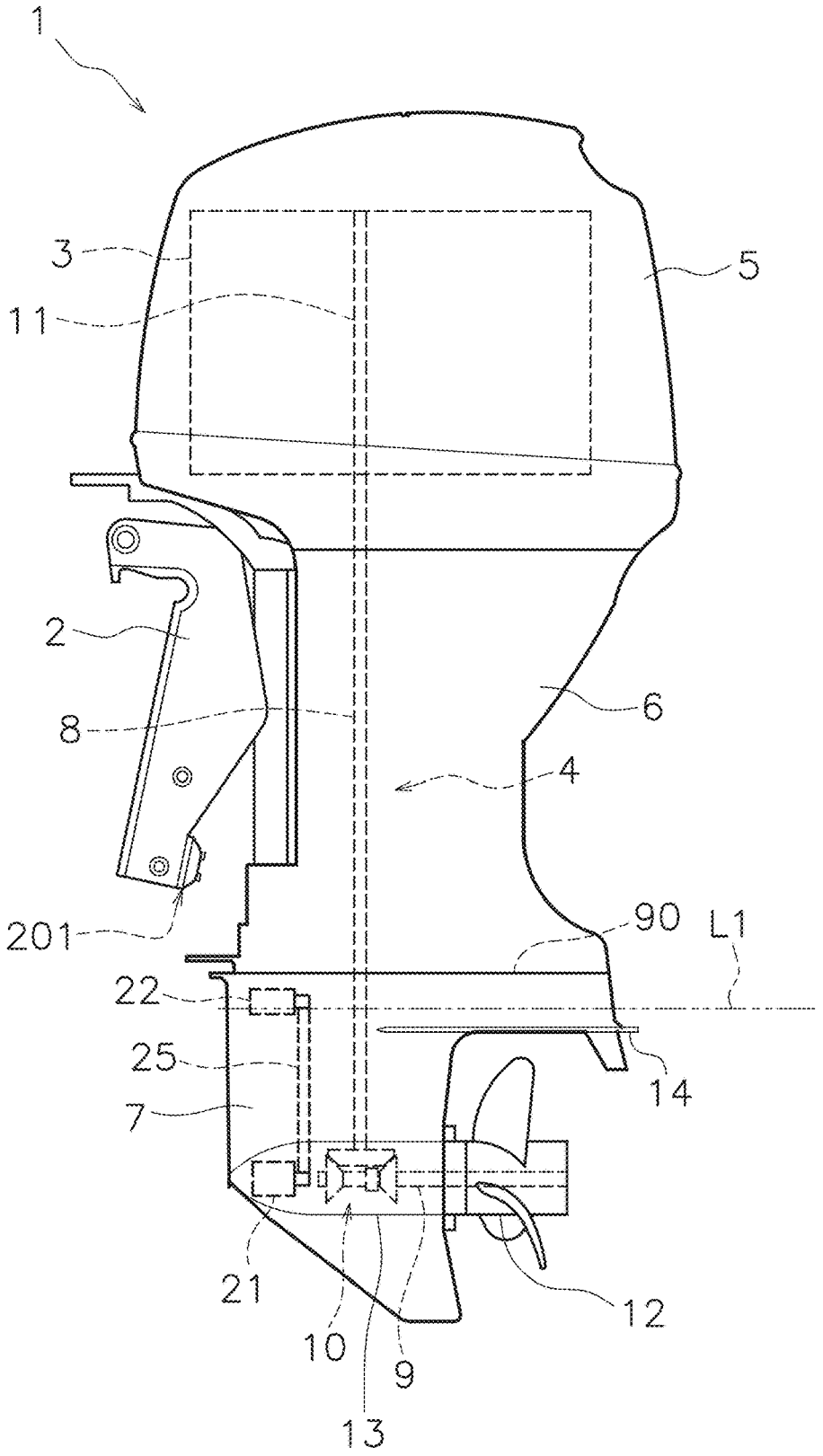
FIG. 1 is a side view of an outboard motor according to a first preferred embodiment of the present invention.

Preferred embodiments will be described below with reference to the drawings. FIG. 1 is a side view of an outboard motor 1 according to a first preferred embodiment of the present invention. The outboard motor 1 includes a bracket 2, an engine 3, a transmission mechanism 4, an engine cowl 5, an upper case 6, and a lower case 7. The outboard motor 1 is attached to a watercraft via the bracket 2.

The engine 3 generates thrust to propel the watercraft. The engine 3 includes a crankshaft 11. The crankshaft 11 extends in the vertical direction of the outboard motor 1. The transmission mechanism 4 transmits the driving force of the engine 3 to the propeller 12. The transmission mechanism 4 includes a drive shaft 8, a propeller shaft 9, and a shift mechanism 10. The drive shaft 8 is connected to the crankshaft 11. The drive shaft 8 extends in the vertical direction of the outboard motor 1. The drive shaft 8 extends downward from the engine 3.

The propeller shaft 9 extends in the front-rear direction of the outboard motor 1. The propeller shaft 9 is connected to the drive shaft 8 via the shift mechanism 10. A propeller 12 is attached to the propeller shaft 9. The shift mechanism 10 includes a plurality of gears and a clutch. The shift mechanism 10 switches the transmission direction of rotation from the drive shaft 8 to the propeller shaft 9. As a result, the watercraft is switched between forward and reverse.

The engine 3 is disposed in the engine cowl 5. The upper case 6 is disposed below the engine 3. The lower case 7 is disposed below the upper case 6. The drive shaft 8 is disposed in the upper case 6 and the lower case 7. The propeller shaft 9 and the shift mechanism 10 are disposed in the lower case 7. Specifically, the lower case 7 includes a torpedo portion 13. The torpedo portion 13 has an outwardly bulging shape. The propeller shaft 9 and the shift mechanism 10 are disposed in the torpedo portion 13. A cavitation plate 14 is connected to the lower case 7. The cavitation plate 14 protrudes rearward from the lower case 7.

Figure 2:
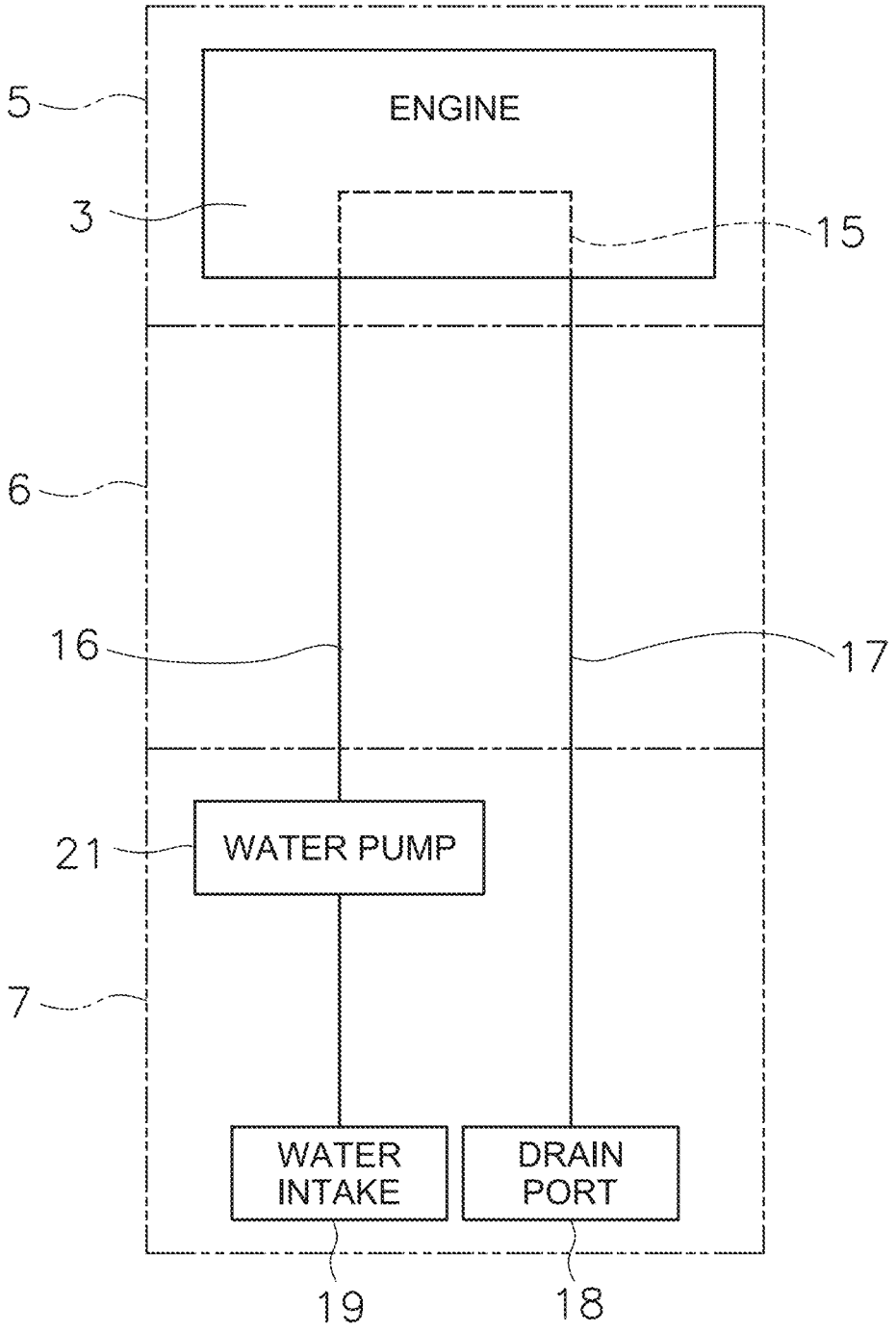
FIG. 2 is a block diagram showing a cooling system of the outboard motor.

FIG. 2 is a block diagram showing a cooling system of the outboard motor 1. As shown in FIG. 2, the engine 3 includes a water jacket 15. The cooling water flowing through the water jacket 15 cools the engine 3. The outboard motor 1 includes a cooling water passage 16 and a drain passage 17.

The cooling water passage 16 and the drain passage 17 are connected to the water jacket 15 of the engine 3. The cooling water passage 16 and the drain passage 17 are disposed in the upper case 6 and the lower case 7.

The cooling water is supplied from the outside of the outboard motor 1 to the water jacket 15 of the engine 3 through the cooling water passage 16. The cooling water is discharged from the water jacket 15 to the outside of the outboard motor 1 through the drain passage 17 and a drain port 18. The drain port 18 is provided in the lower case 7, for example. Alternatively, the drain port 18 may be provided in the upper case 6.

The cooling water passage 16 includes a water intake 19. The outboard motor 1 includes a water pump 21 and an electric motor 22. The water intake 19 is provided in the lower case 7. The water intake 19 communicates with the outside of the outboard motor 1. The cooling water is drawn into the cooling water passage 16 from the outside of the outboard motor 1 through the water intake 19. The water pump 21 is provided in the cooling water passage 16. The electric motor 22 drives the water pump 21. The water pump 21 sends the cooling water to the engine 3 through the cooling water passage 16.

Figure 3:
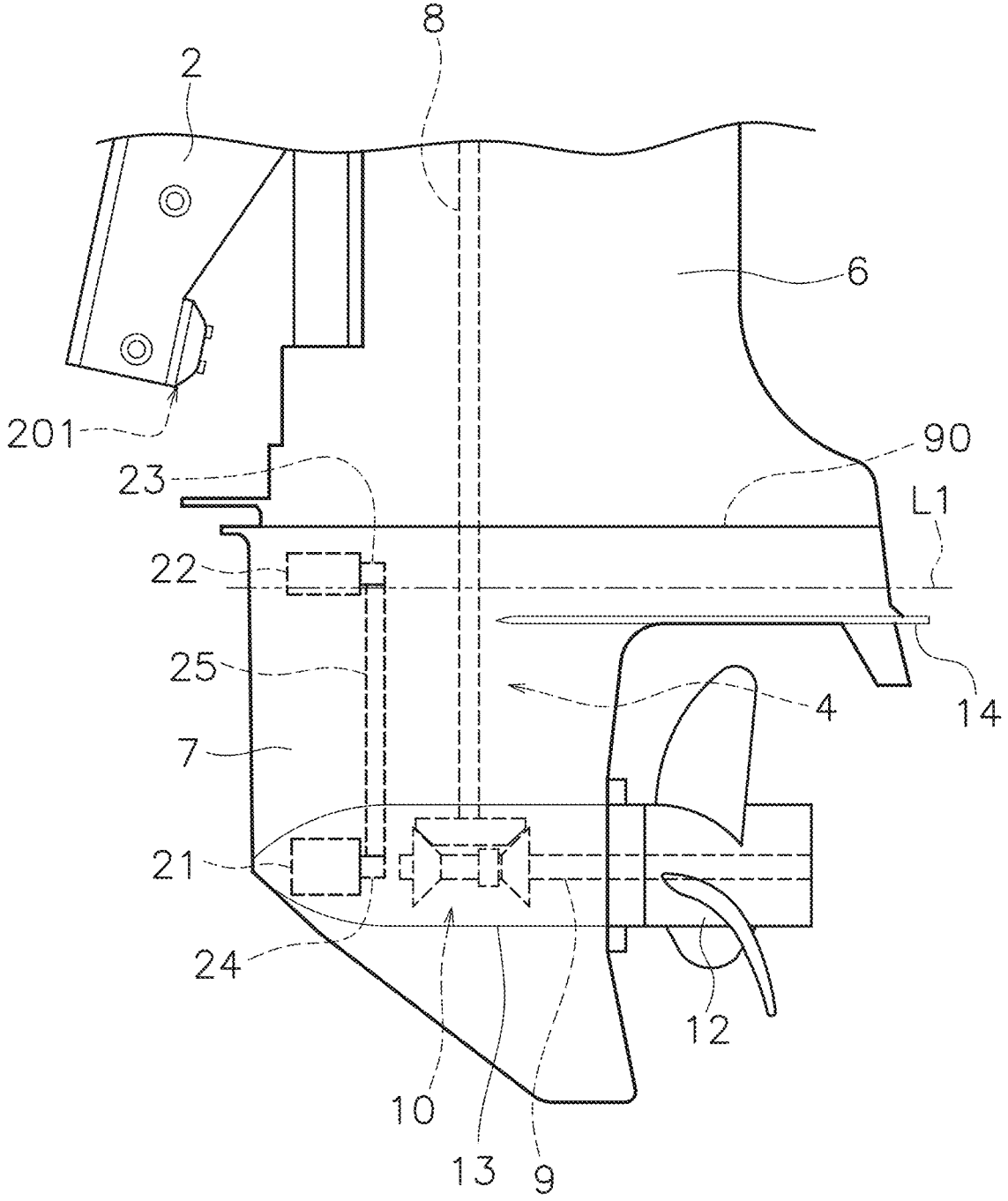
FIG. 3 is an enlarged side view of the outboard motor.

FIG. 3 is an enlarged side view of the outboard motor 1. As shown in FIG. 3, the water pump 21 is disposed below a lower end 201 of the bracket 2. The water pump 21 is disposed in the lower case 7. The water pump 21 is disposed below the cavitation plate 14. The water pump 21 is disposed below the waterline L1 at which the watercraft is stopped. The water pump 21 is disposed in the torpedo portion 13. The water pump 21 is disposed forward of the drive shaft 8. The water pump 21 may be a non-positive displacement pump, for example. For example, the water pump 21 may be a centrifugal pump.

The electric motor 22 is connected to a battery (not shown) and driven by electric power from the battery. The electric motor 22 is disposed below the lower end 201 of the bracket 2. The electric motor 22 is disposed above the cavitation plate 14. The electric motor 22 is disposed between the cavitation plate 14 and the lower end 201 of the bracket 2. The electric motor 22 is disposed between an upper end 90 of the lower case 7 and the cavitation plate 14. At least a portion of the electric motor 22 is disposed below the waterline L1. The electric motor 22 is disposed forward of the drive shaft 8.

The electric motor 22 includes an output shaft 23. The water pump 21 includes an input shaft 24. The output shaft 23 of the electric motor 22 extends in the front-rear direction of the outboard motor 1. The input shaft 24 of the water pump 21 extends in the front-rear direction of the outboard motor 1. The outboard motor 1 includes a transmission member 25. The transmission member 25 is connected to the electric motor 22 and the water pump 21. The transmission member 25 transmits the driving force of the electric motor 22 to the water pump 21. Specifically, the transmission member 25 is connected to the output shaft 23 of the electric motor 22 and the input shaft 24 of the water pump 21. The transmission member 25 transmits rotation of the output shaft 23 to the input shaft 24. The transmission member 25 includes, for example, a belt. Alternatively, the transmission member 25 may include a shaft or other member such as a chain.

In the outboard motor 1 according to the present preferred embodiment, the water pump 21 is driven by the electric motor 22. The water pump 21 sends the cooling water from the water intake 19 to the water jacket 15 of the engine 3 through the cooling water passage 16. The cooling water flowing through the water jacket 15 cools the engine. The cooling water flows from the water jacket 15 through the drain passage 17 and is discharged to the outside of the outboard motor 1 through the drain port 18.

In the outboard motor 1 according to the present preferred embodiment, the water pump 21 is driven by the electric motor 22. Therefore, the water pump 21 is driven according to the required flow rate of the cooling water of the engine 3 regardless of the rotational speed of the engine 3. As a result, it is possible to supply the engine 3 with a suitable amount of the cooling water to cool the engine 3. For example, when the rotation speed of the engine 3 is low, the electric motor 22 is able to be controlled to adjust the flow rate of the cooling water so that the engine 3 does not overcool.

The water pump 21 is disposed in the torpedo portion 13. Therefore, the water pump 21 is disposed below the water surface. Thus, priming water to the water pump 21 is provided. Further, by using a non-positive displacement type pump as the water pump 21, the loss of the driving force of the engine 3 is reduced as compared with the case where a positive displacement pump is used.

By disposing the water pump 21 in the torpedo portion 13, the expansion of the lower case 7 in the lateral direction of the outboard motor 1 due to disposing the water pump 21 is reduced or prevented. As a result, an increase in water resistance to the outboard motor 1 is reduced or prevented.

At least a portion of the electric motor 22 is positioned below the waterline L1. Therefore, at least a portion of the electric motor 22 is disposed below the water surface. That is, at least a portion of the electric motor 22 is disposed at a position submerged in water. The electric motor 22 is thus cooled.

Although a first preferred embodiment of the present invention has been described above, the present invention is not limited to the above first preferred embodiment, and various modifications are possible without departing from the gist of the invention.

Figure 4:
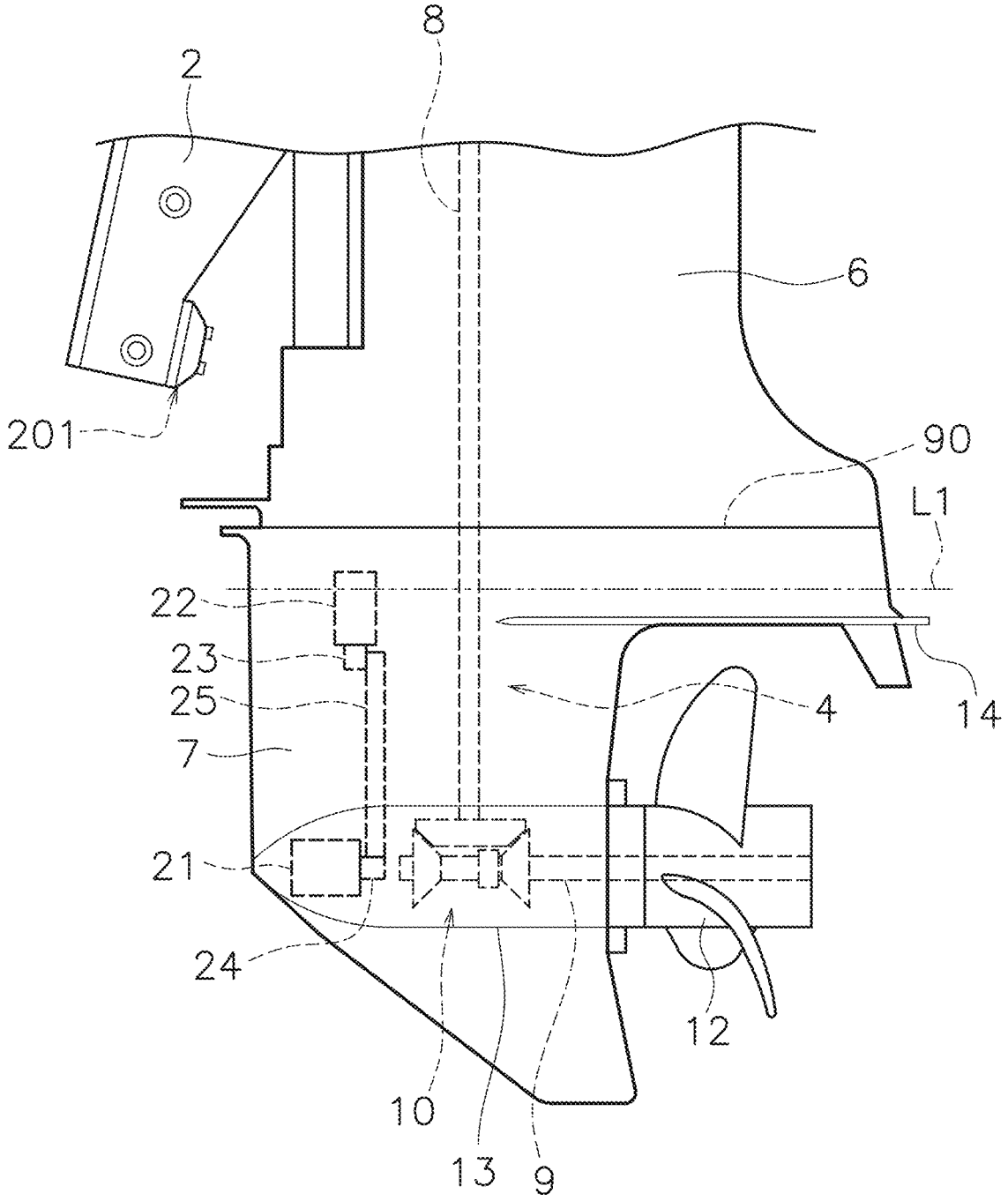
FIG. 4 is a side view of the outboard motor according to a second preferred embodiment of the present invention.

The arrangement of the water pump 21 and the electric motor 22 is not limited to that of the first preferred embodiment, and may be changed. For example, FIG. 4 is an enlarged side view of the outboard motor 1 according to a second preferred embodiment of the present invention. As shown in FIG. 4, the electric motor 22 may be disposed such that the output shaft 23 extends in the vertical direction of the outboard motor 1.

Figure 5:
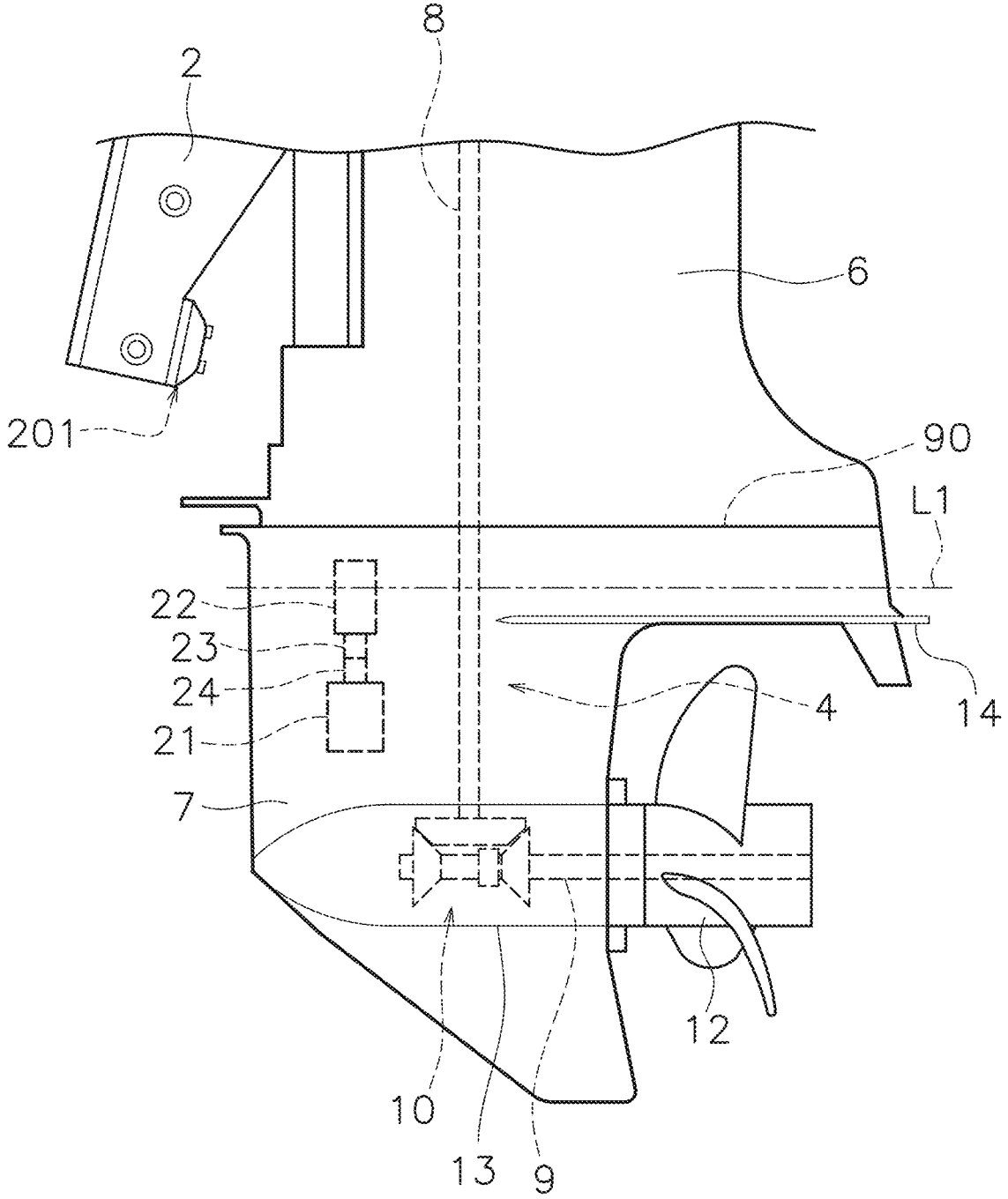
FIG. 5 is a side view of the outboard motor according to a third preferred embodiment of the present invention.

FIG. 5 is an enlarged side view of the outboard motor 1 according to a third preferred embodiment of the present invention. As shown in FIG. 5, the water pump 21 may be disposed such that the input shaft 24 extends in the vertical direction of the outboard motor 1. The input shaft 24 of the water pump 21 may be directly connected to the output shaft 23 of the electric motor 22. That is, the transmission member 25 may be omitted. At least a portion of the electric motor 22 may be disposed below the cavitation plate 14. At least a portion of the water pump 21 may be disposed above the torpedo portion 13. At least a portion of the water pump 21 may be disposed between the torpedo portion 13 and the cavitation plate 14.

Figure 6:
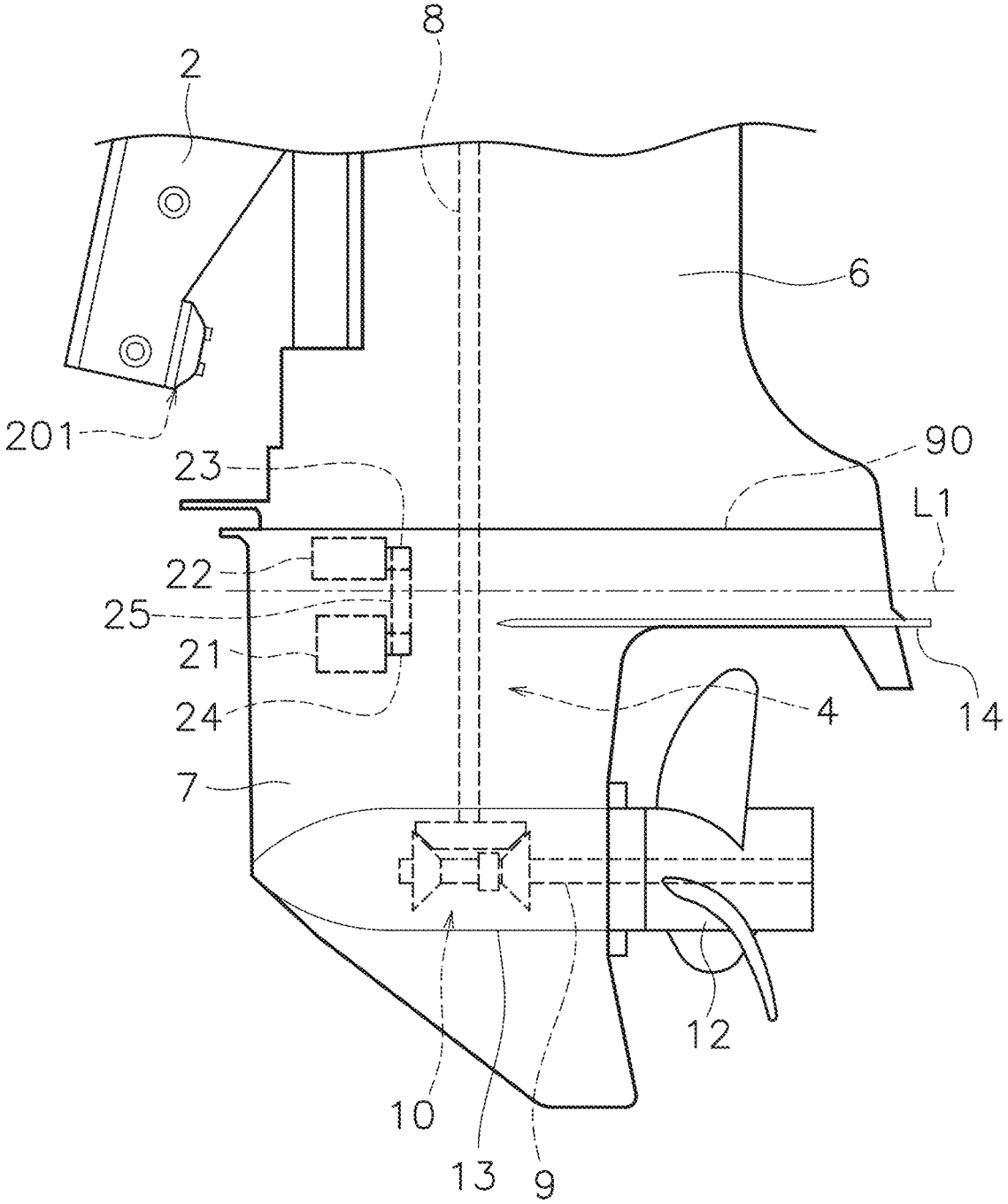
FIG. 6 is a side view of the outboard motor according to a fourth preferred embodiment of the present invention.

FIG. 6 is an enlarged side view of the outboard motor 1 according to a fourth preferred embodiment of the present invention. At least a portion of the water pump 21 may be disposed between the cavitation plate 14 and the lower end 201 of the bracket 2, as shown in FIG. 6.

Figure 7:
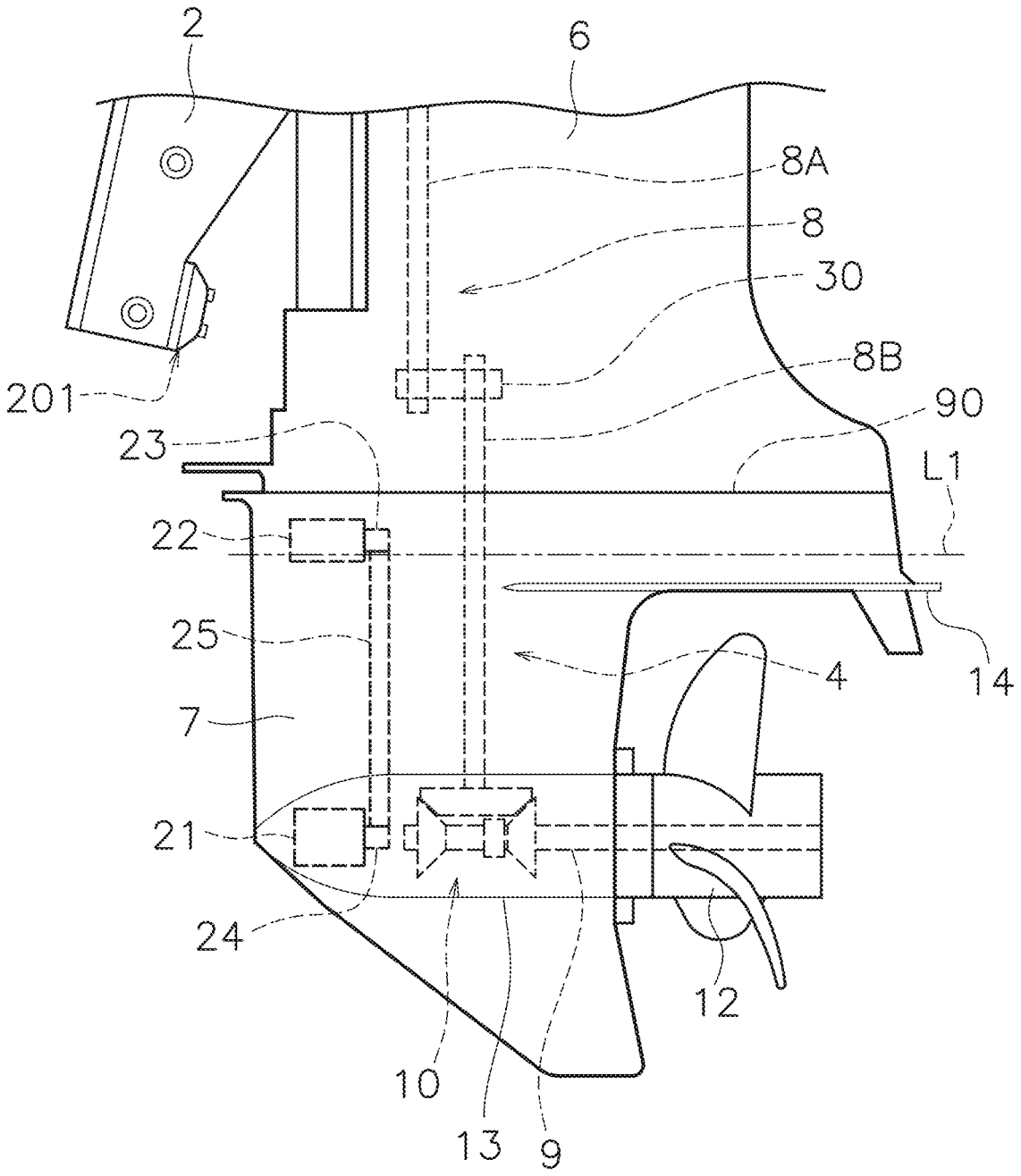
FIG. 7 is a side view of the outboard motor according to a fifth preferred embodiment of the present invention.

The configuration of the transmission mechanism 4 is not limited to that of the above preferred embodiments, and may be modified. For example, FIG. 7 is a side view of the outboard motor 1 according to a fifth preferred embodiment of the present invention. As shown in FIG. 7, the outboard motor 1 according to the fifth preferred embodiment includes an offset drive shaft 8. The offset drive shaft 8 includes a first drive shaft 8A and a second drive shaft 8B. The first drive shaft 8A is connected to the crankshaft 11. The second drive shaft 8B is connected to the propeller shaft 9 via the shift mechanism 10. The first drive shaft 8A and the second drive shaft 8B are eccentric relative to each other.

The transmission mechanism 4 includes a link mechanism 30. The second drive shaft 8B is connected to the first drive shaft 8A via the link mechanism 30 such as a gear or a belt. In the fifth preferred embodiment, the water pump 21 and the electric motor 22 are disposed similarly to the water pump 21 and the electric motor 22 according to the first preferred embodiment, respectively.

Figure 8:
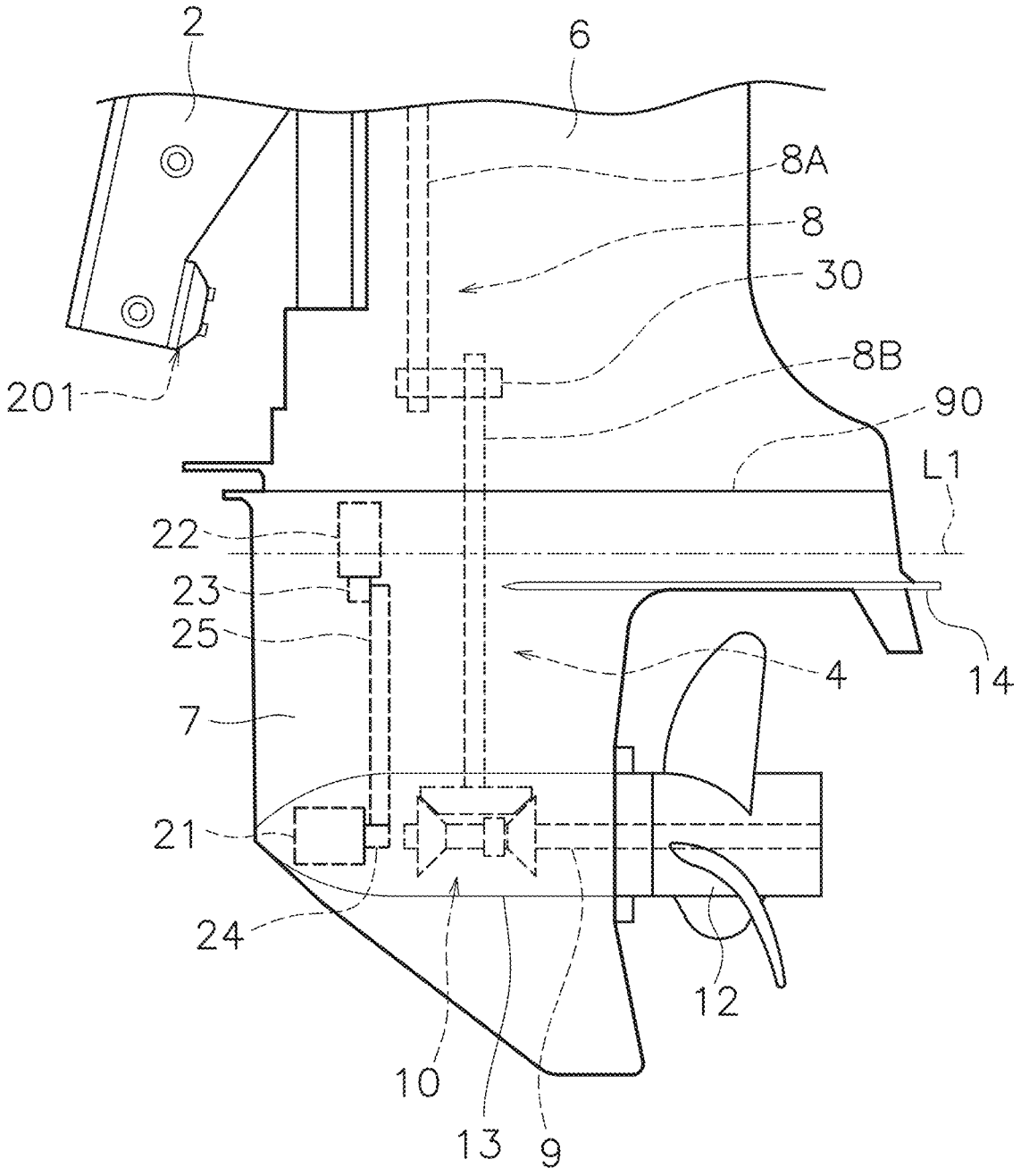
FIG. 8 is a side view of the outboard motor according to a sixth preferred embodiment of the present invention.

FIG. 8 is a side view of the outboard motor 1 according to a sixth preferred embodiment of the present invention. As shown in FIG. 8, the outboard motor 1 according to the sixth preferred embodiment includes an offset drive shaft 8, like the outboard motor 1 according to the fifth preferred embodiment. Further, in the sixth preferred embodiment, the water pump 21 and the electric motor 22 are disposed similarly to the water pump 21 and the electric motor 22 according to the second preferred embodiment, respectively.

Figure 9:
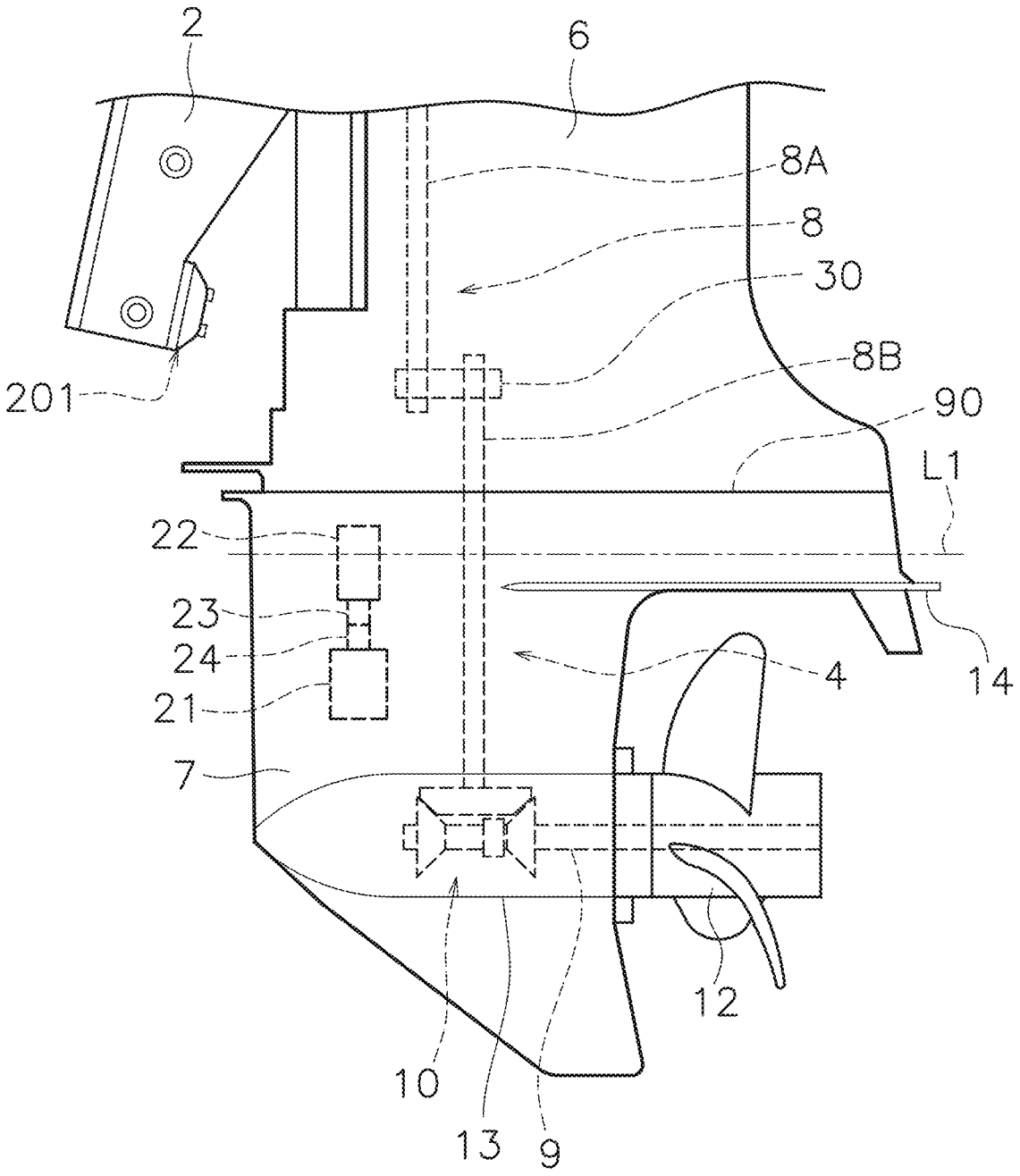
FIG. 9 is a side view of the outboard motor according to a seventh preferred embodiment of the present invention.

FIG. 9 is a side view of the outboard motor 1 according to a seventh preferred embodiment of the present invention. As shown in FIG. 9, the outboard motor 1 according to the seventh preferred embodiment includes an offset drive shaft 8, like the outboard motor 1 according to the fifth preferred embodiment. Further, in the seventh preferred embodiment, the water pump 21 and the electric motor 22 are disposed similarly to the water pump 21 and the electric motor 22 according to the third preferred embodiment, respectively.

Figure 10:
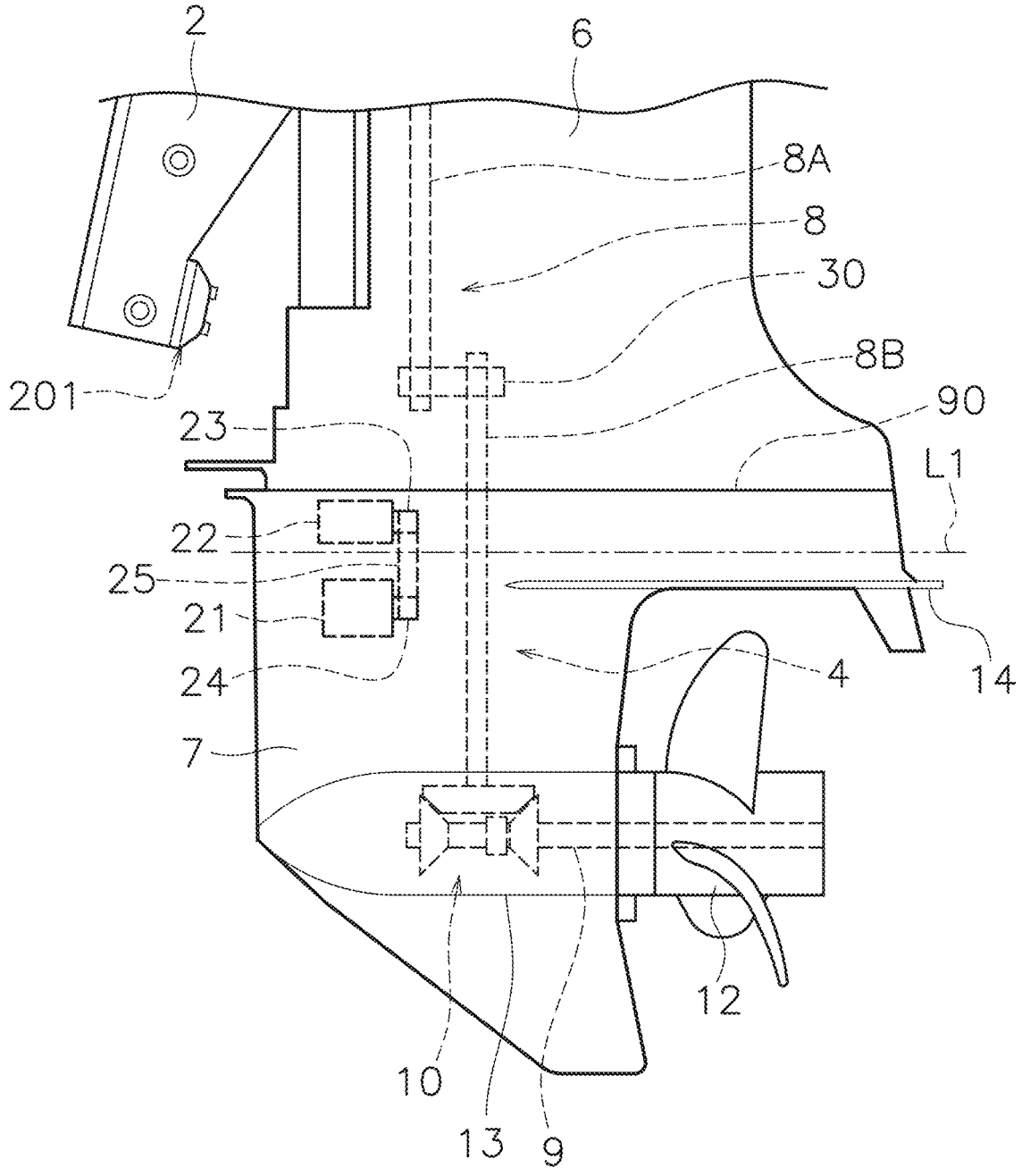
FIG. 10 is a side view of the outboard motor according to an eighth preferred embodiment of the present invention.

FIG. 10 is a side view of the outboard motor 1 according to an eighth preferred embodiment of the present invention. As shown in FIG. 10, the outboard motor 1 according to the eighth preferred embodiment includes an offset drive shaft 8, like the outboard motor 1 according to the fifth preferred embodiment. Further, in the eighth preferred embodiment, the water pump 21 and the electric motor 22 are disposed similarly to the water pump 21 and the electric motor 22 according to the fourth preferred embodiment, respectively.

In the preferred embodiments described above, the water pump 21 may be a centrifugal pump. However, the water pump 21 is not limited to a centrifugal pump, and may be another non-positive displacement pump such as an axial pump. Alternatively, the water pump 21 may be a positive displacement pump such as a gear pump or a vane pump.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
a bracket to mount the outboard motor on a watercraft;
an engine;
an upper case below the engine;
a lower case below the upper case;
a drive shaft extending downward from the engine and located in the upper case and the lower case;
a propeller shaft connected to the drive shaft, extending in a front-rear direction of the outboard motor, and located in the lower case;
a cooling water passage connected to the engine and located in the upper case and the lower case;
a water pump below a lower end of the bracket and operable to send cooling water to the engine through the cooling water passage; and
an electric motor to drive the water pump; wherein
the outboard motor does not include a water pump driven by a driving force of the engine.

2. The outboard motor according to claim 1, wherein the water pump is a non-positive displacement pump.

3. The outboard motor according to claim 2, wherein the water pump is a centrifugal pump.

4. The outboard motor according to claim 2, wherein the water pump is an axial pump.

5. The outboard motor according to claim 1, wherein
the lower case includes a torpedo portion having a shape that bulges outward;
the propeller shaft is in the torpedo portion; and
at least a portion of the water pump is in the torpedo portion.

6. The outboard motor according to claim 1, further comprising:
a cavitation plate connected to the lower case; wherein
at least a portion of the water pump is between the cavitation plate and the lower end of the bracket.

7. The outboard motor according to claim 1, wherein at least a portion of the water pump is forward of the drive shaft.

8. The outboard motor according to claim 1, wherein at least a portion of the electric motor is below the lower end of the bracket.

9. The outboard motor according to claim 1, further comprising:
a cavitation plate connected to the lower case; wherein
at least a portion of the electric motor is between the cavitation plate and the lower end of the bracket.

10. The outboard motor according to claim 1, wherein at least a portion of the electric motor is forward of the drive shaft.

11. The outboard motor according to claim 1, further comprising:
a transmission to connect the electric motor and the water pump.

12. The outboard motor according to claim 11, wherein the transmission includes a belt, a shaft, or a chain.

* * * * *